United States Patent [19]

Shortte, Jr.

[11] 4,100,863

[45] Jul. 18, 1978

[54] TUFTING MACHINE

[75] Inventor: Willard Harmond Shortte, Jr., La Grange, Ga.

[73] Assignee: Milliken Research Corporation, Spartanburg, S.C.

[21] Appl. No.: 814,222

[22] Filed: Jul. 11, 1977

Related U.S. Application Data

[63] Continuation of Ser. No. 662,262, Feb. 27, 1976, abandoned.

[51] Int. Cl.[2] ..... D05C 15/28

[52] U.S. Cl. ..... 112/79 R

[58] Field of Search ..... 112/79 R, 79 A, 79 FF, 112/78, 410, 411, 266

[56] References Cited

U.S. PATENT DOCUMENTS

| | | | |
|---|---|---|---|
| 3,203,388 | 8/1965 | Parlin et al. | 112/79 R X |
| 3,220,371 | 11/1965 | Short et al. | 112/79 R X |
| 3,393,654 | 7/1968 | Barnes | 112/79 R |
| 3,440,983 | 4/1969 | Woodcock | 112/79 R |
| 3,577,943 | 5/1971 | Watkins | 112/79 R |
| 3,585,948 | 6/1971 | Cobble | 112/79 R |

*Primary Examiner*—H. Hampton Hunter

*Attorney, Agent, or Firm*—Earle R. Marden; H. William Petry

[57] ABSTRACT

A tufting machine which employs multiple rows of tufting needles and a pair of nip rolls adjacent the needle plate to control movement of the backing material. The nip rolls are shifted laterally one-half gauge for each reciprocation of the needle bar to eliminate the rowing effect in the tufted fabric being produced.

1 Claim, 3 Drawing Figures

TUFTING MACHINE

This is a continuation of application Ser. No. 662,262 filed Feb. 27, 1976 and now abandoned.

Prior to this invention, tufted fabric tended to have unpleasant appearance due to the rowing effect of the loops of yarn tufted into the fabric. This effect was very noticeable in upholstery fabric when the fabric was bent around the arm or back of a chair or sofa which tended to separate the loops and expose the backing material.

Therefore, it is an object of the invention to provide a tufted fabric which reduces the rowing effect of the yarn loops tufted into the fabric.

Other objects and advantages of the invention will become readily apparent as the specification proceeds to describe the invention with reference to the accompanying drawings, in which.

Figure 1:
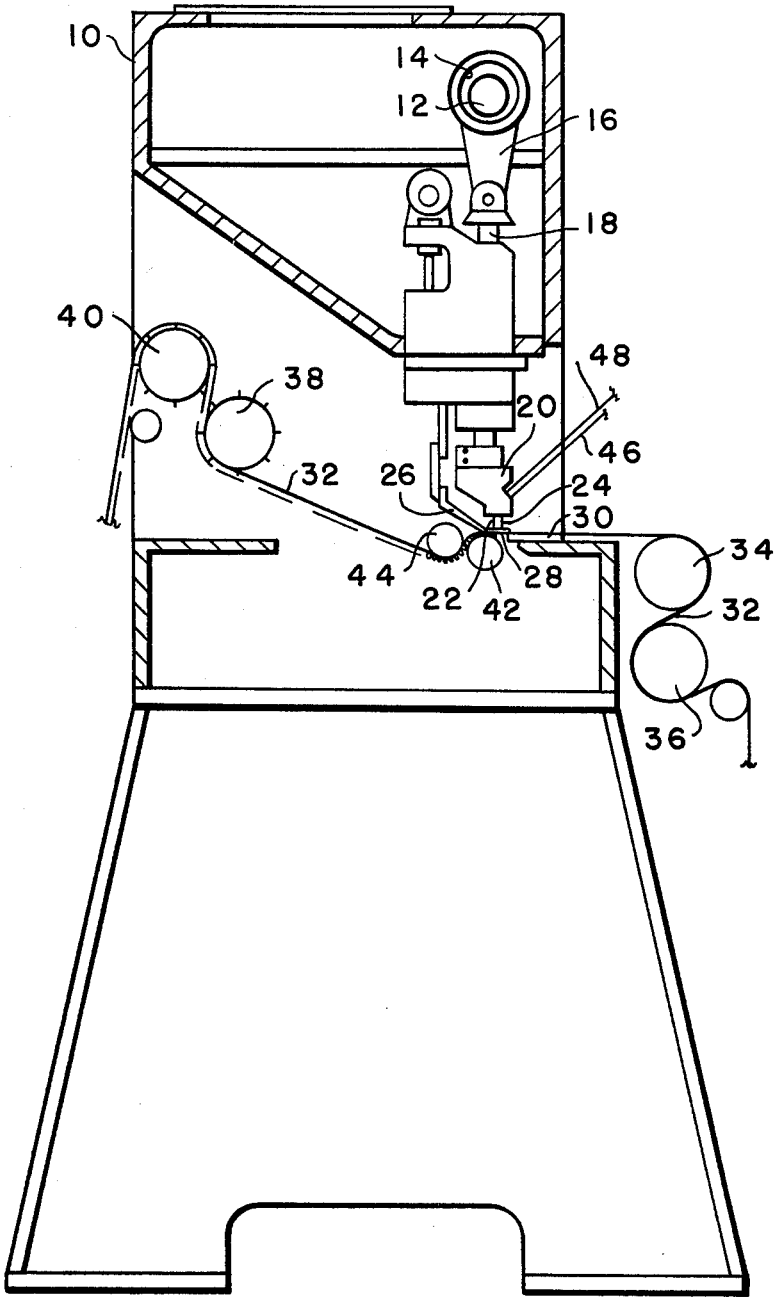
FIG. 1 is a sectional view of a hollow needle tufting machine equipped with a mechanism to shift the backing material.

Looking now to FIG. 1, the reference numeral 10 represents the frame of a hollow needle tufting machine which supports the conventional tufting elements such as the crankshaft 12, the eccentric 14, the connecting rod 16, the needle bar push rod 18, the needle bar 20, the front and back row hollow needles 22 and 24, the presser foot 26, the needle plate 28 and the backing material support plate 30.

The backing material 32 to be tufted is delivered into the tufting machine by front rolls 34 and 36 wherein it is tufted by the conventional action of hollow needles 22 and 24. Then the fabric is delivered to the takeup rolls 38 and 40 through the nip of rubber covered idler rolls 42 and 44 located closely adjacent the tufting needles 22 and 24. The front feed rolls 34 and 36 and the take-up rolls 38 and 40 are driven in synchronism with each other while the rolls 42 and 44 are rotated by the movement of the tufted material therethrough.

The idler rolls 42 and 44 provide control of the tufted fabric, as well as the position of the backing material 32 to be tufted. Furthermore, if a slub or knot appears in one of the tufting yarns 46 or 48 being supplied to the hollow tufting needles, the rolls 42 and 44 will pull the slub or knot through the hollow needle rather than allowing the slub or knot to stop the travel of yarn through the needle to prevent from being withdrawn from the previously formed loops as the fabric progresses toward the take-up rolls 38 and 40.

In the preferred form of the invention, two rows 22 and 24 of hollow needles are employed to tuft two simultaneous rows of yarn. The needles 22 are mounted in staggered relation to the needles 24 so that the tufts in one row are staggered in relation to the tufts or loops in the other row. In known manner, the yarns 46 and 48 extend through passages in the needles, and, as the needles reciprocate to penetrate the backing, the pile yarns 46 and 48 are brought into position with respect to the backing by the gentle action of fluid streams moving through and out the needles.

As discussed briefly before, the tufted loops tend to line up in rows in the longitudinal direction of the fabric creating undesirable effects and therefore, a mechanism has been provided to move the backing fabric relative to the rows of needles upon each reciprocation of the needle bar to break up the appearance of having the tufted loops in a row. Preferably, but not necessarily, mandatory, the backing fabric is moved laterally one-half gauge upon one reciprocation of the needle bar and back one-half gauge on the next reciprocation of the needle bar. This will provide a zig zag pattern of the tufted loops to provide the appearance of a double gauge fabric.

Figure 2:
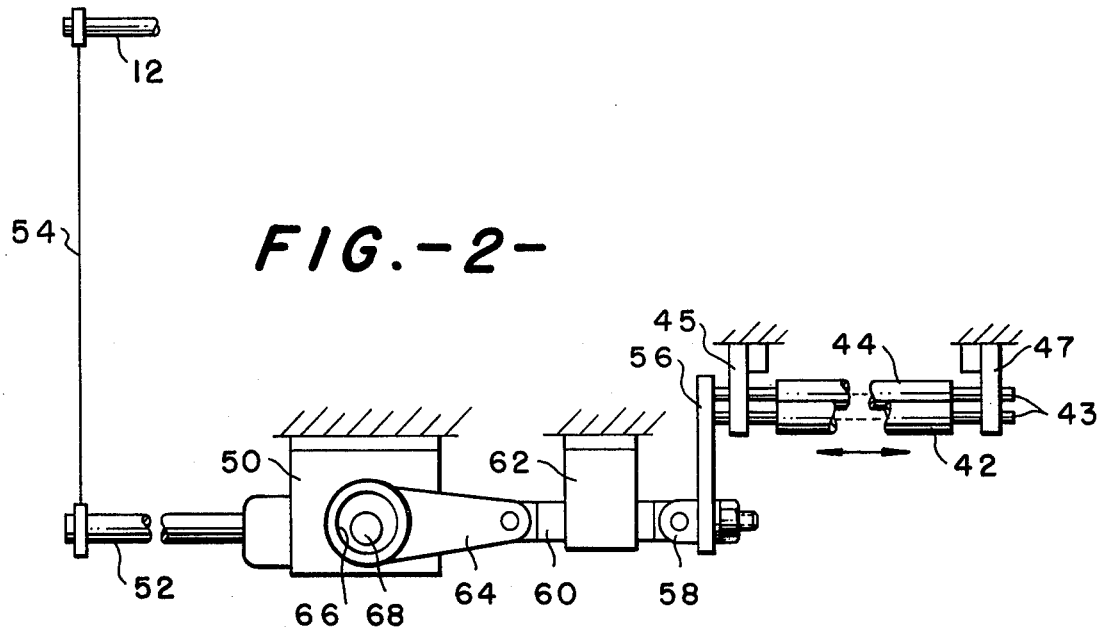
FIG. 2 is a blown up view of the drive and shifting mechanism.
Figure 3:
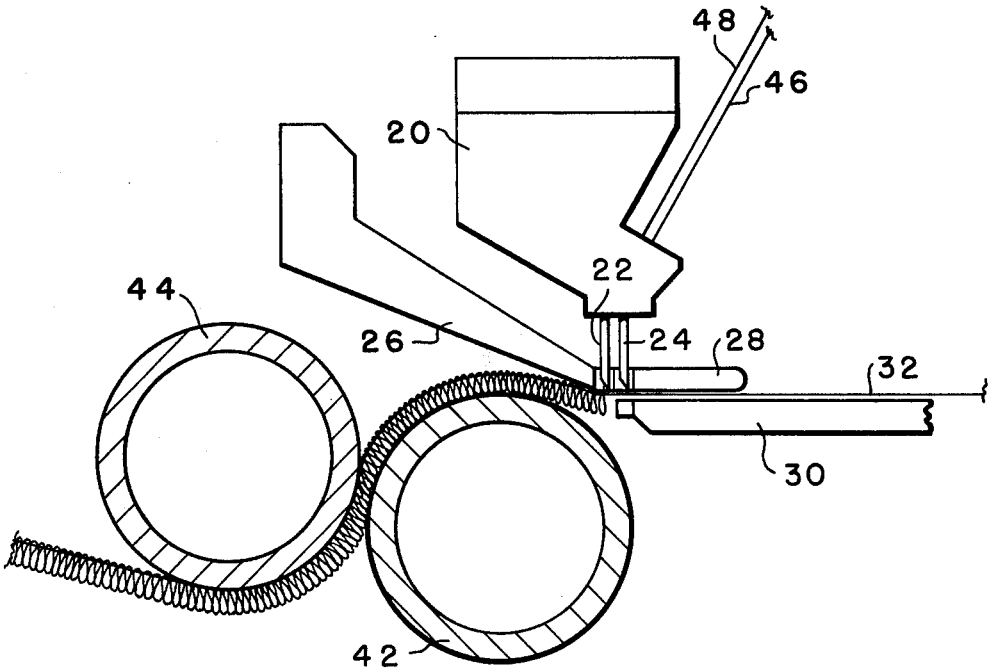
FIG. 3 is a blown up view of the backing material shifting rolls and tufting needles.

This movement of the backing fabric 32 is accomplished by lateral movement of the idler rolls 42 and 44 as shown in FIG. 2. Idler rolls 42 and 44 are rotably supported on shafts 43 which are slidably mounted in bearing blocks 45 and 47 fixed to the machine frame. To slide the shaft 43 laterally to move the backing material 32, a right angle gear box 50, driven by shaft 52 connected to the main drive shaft 12 by suitable linkage 54, is employed. The shafts 43 are fixed to the bracket 56 connected to the clevis 58 which is moved back and forth by the connecting rod 60 supported in the bearing 62. The connecting rod 60 is driven by the rod 64 connected to the eccentric 66 mounted on the output shaft 68 of the gear box 50.

As discussed briefly before, it is desired to shift the backing material one-half a gauge for each reciprocation of the needle bar which is equivalent to one rotation of the drive shaft 12. Therefore, in the desired form of the invention the gear box 50 is selected to provide a 2-1 gear reduction so that upon one rotation of the shaft 12 the rolls 42 and 44 will be slid in one direction and will be returned to the starting position on the next complete rotation of the shaft 12. Obviously, other proportions of movement of the shaft 42 and 44 can be obtained by different selection of gear ratios for the gear box 50. These selections, of course, depend on the selected aesthetic valve desired in the tufted product.

It can readily be seen that the herein disclosed apparatus provides a tufting machine in which the tufted loops in the product are moved out of position relative to adjacent tufted loops to break up the effect of rowing in the product.

Although the preferred embodiment of the invention has been described, it is contemplated that changes may be made without departing from the scope or spirit of the invention and it is desired that the invention be limited only by the claims.

That which is claimed is:

1. Apparatus to produce a tufted pile fabric comprising: a frame, a needle bar mounted in said frame, a first means to reciprocate said needle bar, at least two rows of hollow tufting needles mounted on said needle bar, a needle plate, means to supply a backing material to said rows of hollow tufting needles over said needle plate, means to supply yarn to each of said hollow needles to project the loops of yarn beyond the tip of the needle through said needle plate and the backing material by the action of fluid streams moving through the needles, nip roll means mounted closely adjacent said hollow tufting needles with the centerline of each below said needle plate and on the side of said needles away from the means to supply backing material to guide tufted fabric away from said needles and means to periodically move said roll means laterally of said tufting needles to shift the lateral position of said backing material to lessen the rowing effect in the tufted fabric.

* * * * *

UNITED STATES PATENT OFFICE

CERTIFICATE OF CORRECTION

Patent No. 4,100,863 Dated July 18, 1978

Inventor(s) Willard Harmon Shortte, Jr.

It is certified that error appears in the above-identified patent and that said Letters Patent are hereby corrected as shown below:

Column 1, lines 5 and 6, insert --an-- between "have" and "unpleasant".

Column 1, line 18, insert --type-- between "needle" and "tufting".

Column 2, line 15, the word "shaft" should be --shafts--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*